US006556172B2

(12) United States Patent
Noro

(10) Patent No.: US 6,556,172 B2
(45) Date of Patent: Apr. 29, 2003

(54) SMALL-SIZED MONOPOLE ANTENNA

(75) Inventor: Junichi Noro, Akita (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 52 days.

(21) Appl. No.: 09/966,395

(22) Filed: Sep. 26, 2001

(65) Prior Publication Data

US 2002/0036596 A1 Mar. 28, 2002

(30) Foreign Application Priority Data

Sep. 27, 2000 (JP) ..... 2000-293435

(51) Int. Cl.[7] ..... H01Q 1/32
(52) U.S. Cl. ..... 343/715; 343/700 MS
(58) Field of Search ..... 343/715, 713, 343/900, 700 MS, 846, 848, 702

(56) References Cited

U.S. PATENT DOCUMENTS 6,160,512 A * 12/2000 Desclos et al. ..... 343/700 MS
6,313,801 B1 * 11/2001 Sanford et al. ..... 343/725

* cited by examiner

*Primary Examiner*—Hoang Nguyen
(74) *Attorney, Agent, or Firm*—Frishauf, Holtz, Goodman & Chick, P.C.

(57) ABSTRACT

In a monopole antenna, an antenna element is fitted into a dielectric body having a predetermined relative dielectric constant. A wavelength of a propagation wave is shortened by the shortening coefficient of wavelength which corresponds to the predetermined relative dielectric constant of the dielectric body. In this case, the antenna length of the antenna element can be shortened, so as to be equal to the shortened wavelength of 1/n of the shortened wavelength, "n" being integer. Thus the monopole antenna is small-sized.

7 Claims, 2 Drawing Sheets

SMALL-SIZED MONOPOLE ANTENNA

BACKGROUND OF THE INVENTION

This invention relates to a monopole antenna for wireless communication system, and more particularly to a simplified, small-sized monopole antenna.

A monopole antenna has the simplest structure and is used in various antenna systems, for example, an antenna system mounted on a vehicle. In general, an antenna system mounted on a vehicle also comprises a helical antenna as an antenna for a circularly polarized wave, in addition to a monopole antenna. In the antenna system, the helical antenna and the monopole antenna are arranged in parallel to each other, and are covered by a top cover.

In recent years, an antenna system is required to be small-sized, and accordingly, a monopole antenna also is desired to be small-sized. For example, the size and outward appearance of an antenna system mounted on a vehicle depends on the profile of the top cover of the antenna system. For the profile of the top cover to be small-sized, the physical height or length of the monopole antenna should be small or short.

The physical height or length of a monopole antenna is closely related to an antenna length of the monopole antenna. In addition, the antenna length of the monopole antenna must be in compliance with the reception wavelength. Therefore, it is difficult to simply shorten the physical height or length of the monopole antenna.

As is apparent from the above description, a need exists for a small-sized monopole antenna that considers the relationship between an antenna length and a reception wavelength.

In recent years, an antenna system is required to be small-sized, and accordingly, a monopole antenna also desired to be small-sized. For example, a size and an outward appearance of an antenna system mounted on a vehicle depend on the profile of the top cover of the antenna system. For the profile of the top cover to be small-sized, it is effective that a physical height or length of a monopole antenna be small or short.

The physical height or length of monopole antenna is closely related to an antenna length of the monopole antenna. In addition, the antenna length of the monopole antenna must be decided in compliance with the reception wavelength. Therefore, it is difficult to simply shorten the physical height or length of the monopole antenna.

As apparent from the above description, a need exists for a small-sized monopole antenna that considers the relationship between an antenna length and a reception wavelength.

SUMMARY OF THE INVENTION

The present invention provides a monopole antenna which is designed in consideration of the shorting effect of wavelength that wavelength of a wave is shortened when the wave propagates in dielectric in comparison with the case of the propagation wave in vacuum.

According to one aspect of the present invention, a method of designing a monopole antenna comprising a dielectric body and an antenna element is provided as the followings. Herein, the dielectric body has a predetermined relative dielectric constant as its characteristic, while the antenna element has a predetermined antenna length.

In the designing method according to one aspect of the present invention, a shortening coefficient of wavelength is calculated, corresponding to the predetermined relative dielectric constant of the dielectric body. Then the wavelength of a propagation wave, which is shortened in accordance with the shortening coefficient of wavelength, is specified. Furthermore, the predetermined antenna length is decided, so as to be proportional to the specified wavelength.

With the method mentioned above, the predetermined antenna length of the monopole antenna is shortened, and accordingly, the physical height or length of the monopole antenna becomes small or short.

In connection with the above-method, a monopole antenna described below is obtained as another aspect of the present invention.

The monopole antenna according to another aspect of the present invention comprises a dielectric body, an antenna element, and a ground plane conductor. The dielectric body has top and bottom surfaces and a first through hole formed between the top and bottom surface and communicating the top and bottom surfaces with each other. The dielectric body has a predetermined relative dielectric constant, as its characteristics. The antenna element is fitted into the first through hole. The antenna element has a predetermined antenna length that is proportional to a wavelength shortened in accordance with a shortening coefficient of wavelength corresponding to the predetermined relative dielectric constant of the dielectric body. The ground plane conductor has a second through hole and is fitted on the bottom surface of the dielectric body, so that the antenna element does not contact with the ground plane conductor.

A more complete understanding of the present invention, as well as further features and advantages of the present invention, will be obtained by reference to the following detailed description and drawings.

DESCRIPTION OF THE PREFERRED EMBODIMENT

Figure 1:
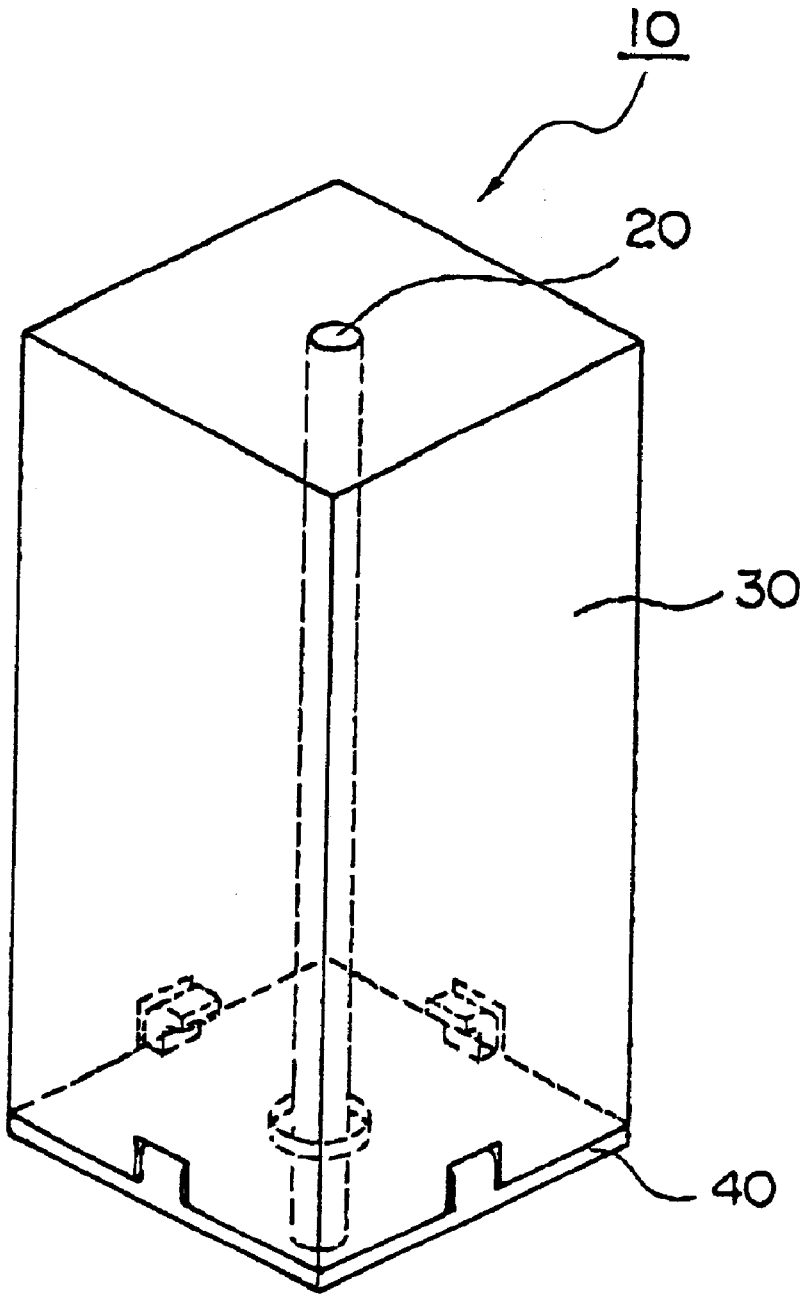
FIG. 1 is a perspective view showing a monopole antenna according to one aspect of the present invention.
Figure 2:
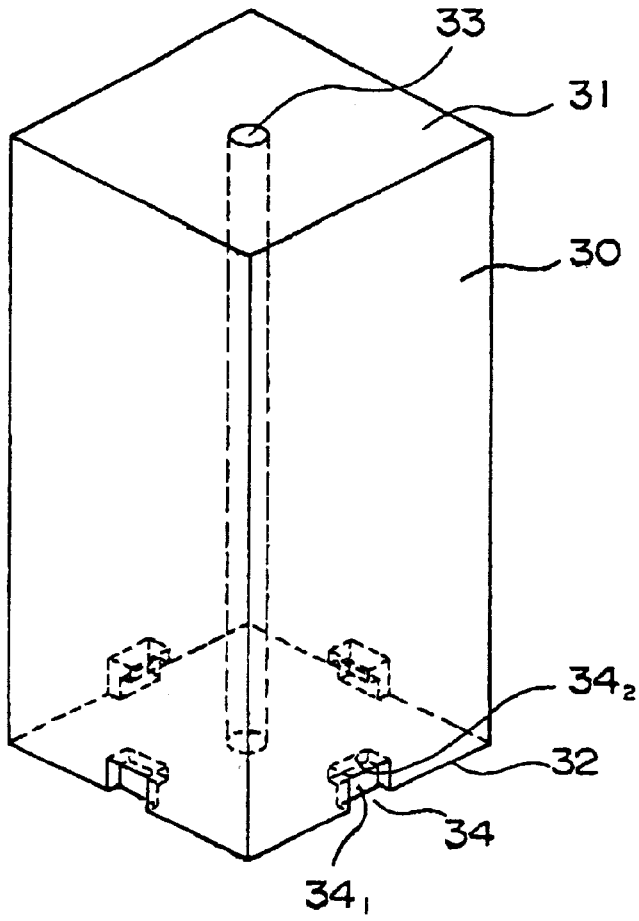
FIG. 2 is a perspective view showing a dielectric body illustrated in FIG. 1.
Figure 3:
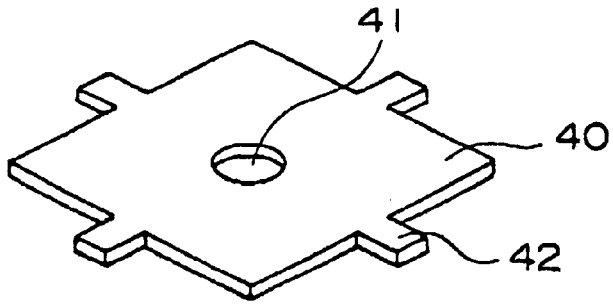
FIG. 3 is a perspective view showing a ground plane conductor which is illustrated in FIG. 1.

A detailed description of a preferred embodiment of the present invention is provided with reference to FIGS. 1 to 3.

With reference to FIG. 1, a monopole antenna 10 comprises an antenna elements 20, a dielectric body 30, and a ground plane conductor 40. In this embodiment, the dielectric body 30 is made of ceramics, and the antenna element 20 has a cylindrical stick shape that has first and second ends.

With also reference to FIG. 2, the dielectric body 30 according to the present embodiment has a rectangular shape comprising a top surface 31, a bottom surface 32 and four side surfaces, and is formed with a first through hole 33 between the top and bottom surfaces 31, 32. In this embodiment, the top surface 31 and the bottom surface 32 has the square shape. In addition, the illustrated first through hole 33 is a cylindrical straight hole which has the diameter substantially equal to that of the antenna element 20, and communicates the top and bottom surfaces 31, 32. Within the first through hole 33, the antenna element 20 is fitted and held, so that the first end of the antenna element 20 is arranged to be on the same plane as the top surface 31 while the second end is arranged to be protruded from the bottom surface 32, as illustrated in FIG. 1.

In FIG. 2, the dielectric body 30 is provided with four recesses 34 on corners between the bottom surface 32 and the side surfaces. Each recess 34 comprises first and second step portions $\mathbf{34}_1$, $\mathbf{34}_2$. The first step portion $\mathbf{34}_1$ is faced to the bottom surface, and has a first depth when seen from the front of the respective side surface. In this embodiment, the first depth is substantially equal to the thickness of the material of the ground plane conductor 40, as mentioned later. The second step portion $\mathbf{34}_2$ is integrally formed with the respective first step portion $\mathbf{34}_1$, and has a second depth when seen from the front of the respective side surface. The second depth of the second step portion $\mathbf{34}_2$ is deeper than the first depth of the first step portion $\mathbf{34}_1$, so that the recess 34 has a stair-like shape.

Further referring to FIG. 3, the ground plane conductor 40 comprises a substantial square portion formed with a second through hole 41 on the center of the portion. The second through hole 41 has a diameter larger than that of the first through hole 33, namely, the diameter of the antenna element 20. Therefore, the antenna element 20 does not contact with the ground plane conductor 40 when the ground plane conductor 40 is fitted on the bottom surface 32 of the dielectric body 30.

In addition, the ground plane conductor 40 is provided with four tabs 42, as shown in FIG. 3. The tabs 42 outwardly project from the edges of the substantial square portion of the ground plane conductor 40, on the condition before the ground plant conductor 40 is fitted on the bottom surface 32. The tabs 42 is bent and is put into the recesses 34 along the first and second step portions $\mathbf{34}_1$, $\mathbf{34}_2$, so that the ground plane conductor 40 is fitted and fixed on the bottom surface 32 of the dielectric body 30, as shown in FIG. 1. The projection length of each tab 42 may be selected to be equal to a path-length from the bottom surface 32 to the bottom of the second step portion $\mathbf{34}_2$.

In the above-mentioned monopole antenna 10, the antenna element 20 has a predetermined antenna length determined on the basis of the shorting effect of wavelength. The shorting effect of wave length is that wavelength of a wave is shortened when the wave propagates in dielectric in comparison with the case of the propagation wave in vacuum, and ratio of wavelengths between the dielectric case and the vacuum case is referred to as a shorting coefficient of wavelength. In general, a shorting coefficient of wave length is represented by the following equation:

$$\lambda/\lambda_0=1/\sqrt{\epsilon^*}$$

where $\lambda$ and $\lambda_0$ correspond to the same propagation wave or reception wave, and represent wavelengths in dielectric and vacuum, respectively, and $\epsilon^*$ represents a relative dielectric constant. As apparent from the above equation, a propagation wavelength $\lambda$ is shortened to be equal to $\lambda_0/\sqrt{\epsilon^*}$.

In detail, the predetermined antenna length of the antenna element 20 is determined as the following manner, the dielectric body having a predetermined relative dielectric constant. First, the shortening coefficient of wavelength is calculated, on the basis of the above-described equation and by the use of the predetermined relative dielectric constant of the dielectric body 30. Then the wavelength of a propagation wave, which is shortened in accordance with the shortening coefficient of wavelength, is specified. Furthermore, the predetermined antenna length is decided, so as to be proportional to the specified wavelength. That is, the predetermined antenna length is selected to be equal to the shortened wavelength or 1/n of the shortened wavelength, "n" being integer.

For example, the relative dielectric constant of alumina ceramics is 9.8 and the shortening coefficient of wavelength is about 0.3194. In this case, the wavelength of a propagation wave in dielectric is shortened to be substantially equal to ⅓ of the wavelength of the propagation wave in vacuum. The predetermined antenna length is decided, so as to be proportional to the wavelength in dielectric, so as to be shortened. As the results, the physical height or length of the monopole antenna 10 can be small or short, and the antenna system comprising the monopole antenna 10 is also small-sized.

A general description of the present invention as well as a preferred embodiment of the present invention has been set forth above. Those skilled in the art to which the present invention pertains will recognize and be able to practice additional variations in the methods and system described which fall within the teachings of this invention. For example, although the shape of the dielectric body is rectangular in the above description, various prisms can be applied to the shape of the dielectric body. All such modifications and additions are deemed to be within the scope of the invention which is to be limited only by the claims appended hereto.

The entire disclosure of Japanese Patent Application No. 2000-293435 filed on Sep. 27, 2000 including specification, claims, drawings and summary are incorporated herein by reference in its entirety.

What is claimed is:

1. A monopole antenna comprising:

a dielectric body having top and bottom surfaces and a first through hole between the top and bottom surfaces, the dielectric body having a predetermined relative dielectric constant;

an antenna element fitted into the first through hole, the antenna element having a predetermined antenna length that is proportional to a wavelength shortened in accordance with a shortening coefficient of wavelength corresponding to the predetermined relative dielectric constant of the dielectric body; and a ground plane conductor having a second through hole and fitted on the bottom surface of the dielectric body, so that the antenna element does not contact the ground plane conductor;

wherein the antenna element has first and second ends, the first end is on the same plane as the top surface of the dielectric body, while the second end protrudes from the bottom surface of the dielectric body.

2. A monopole antenna as claimed in claim 1 wherein the dielectric body comprises a ceramic.

3. A monopole antenna as claimed in claim 1, wherein the dielectric body has a rectangular shape comprising the top and bottom surfaces and four side surfaces.

4. A monopole antenna as claimed in claim 3, wherein:

the dielectric body includes four recesses each having first and second step portions on corners between the bottom surface and the side surfaces, each of the first step portions being faced to the bottom surface and having a first depth, each of the second step portions being integrally formed with a corresponding one of the first step portions and having a second depth greater than the first depth, and the ground plane conductor has a square shape with four tabs, the tabs being bent and being put into the recesses along the first and second step portions so that the ground plane conductor is fitted on the bottom surface of the dielectric body.

5. A monopole antenna as claimed in claim 1, wherein the first through hole is a cylindrical straight hole, while the antenna element has a cylindrical stick shape.

6. A monopole antenna comprising:

a dielectric body having top and bottom surfaces and a first through hole between the top and bottom surfaces, the dielectric body having a predetermined relative dielectric constant;

an antenna element fitted into the first through hole, the antenna element having a predetermined antenna length that is proportional to a wavelength shortened in accordance with a shortening coefficient of wavelength corresponding to the predetermined relative dielectric constant of the dielectric body; and a ground plane conductor having a second through hole and fitted on the bottom surface of the dielectric body, so that the antenna element does not contact the ground plane conductor;

wherein the dielectric body has a rectangular shape comprising the top and bottom surfaces and four side surfaces, the dielectric body including four recesses each having first and second step portions of corners between the bottom surface and the side surfaces, each of the first step portions being faced to the bottom surface and having a first depth, each of the second step portions being integrally formed with a corresponding one of the first step portions and having a second depth greater than the first depth, and the ground plane conductor has a square shape with four tabs, the tabs being bent and being put into the recesses along the first and second step portions so that the ground plane conductor is fitted on the bottom surface of the dielectric body.

7. A monopole antenna as claimed in claim 6, wherein the first through hole is a cylindrical straight hole, while the antenna element has a cylindrical stick shape.

* * * * *

UNITED STATES PATENT AND TRADEMARK OFFICE

CERTIFICATE OF CORRECTION

PATENT NO. : 6,556,172 B2
DATED : April 29, 2003
INVENTOR(S) : Junichi Noro

It is certified that error appears in the above-identified patent and that said Letters Patent is hereby corrected as shown below:

Column 1,
Delete lines 35-52, paragraphs 6-8.

Signed and Sealed this

Fifth Day of April, 2005

JON W. DUDAS
*Director of the United States Patent and Trademark Office*